US006210075B1

(12) United States Patent
Korloo

(10) Patent No.: US 6,210,075 B1
(45) Date of Patent: Apr. 3, 2001

(54) SPAR SYSTEM

(75) Inventor: Jafar Korloo, Moorpark, CA (US)

(73) Assignee: Imodco, Inc.

( * ) Notice: Subject to any disclaimer, the term of this patent is extended or adjusted under 35 U.S.C. 154(b) by 0 days.

(21) Appl. No.: 09/234,740

(22) Filed: Jan. 21, 1999

Related U.S. Application Data

(60) Provisional application No. 60/074,469, filed on Feb. 12, 1998.

(51) Int. Cl.[7] ..... B63B 22/20; F21B 43/01

(52) U.S. Cl. ..... 405/206; 405/224.2; 441/4; 166/345

(58) Field of Search ..... 405/195.1, 196, 405/200, 203, 205, 206, 207, 223.1, 224, 224.2; 166/345, 367, 350; 441/3, 4, 5

(56) References Cited

U.S. PATENT DOCUMENTS

| | | | | |
|---|---|---|---|---|
| 3,196,958 | | 7/1965 | Travers et al. . | |
| 3,677,310 | * | 7/1972 | Dobler et al. | 441/4 |
| 3,778,854 | * | 12/1973 | Chow | 441/4 |
| 3,982,401 | * | 9/1976 | Loggins | 405/200 |
| 4,130,076 | | 12/1978 | van Bilderbeek . | |
| 4,234,047 | | 11/1980 | Mott . | |
| 4,284,143 | * | 8/1981 | Scherrer et al. | 166/350 |
| 4,371,037 | * | 2/1983 | Arnaudeau | 441/4 |
| 4,630,681 | | 12/1986 | Iwamoto . | |
| 4,637,335 | * | 1/1987 | Pollack | 441/4 |
| 4,702,321 | * | 10/1987 | Horton | 166/350 |
| 4,906,139 | * | 3/1990 | Chiu et al. | 205/224 |
| 5,098,323 | * | 3/1992 | Poldervaart et al. | 441/4 |
| 5,558,467 | * | 9/1996 | Horton | 405/195.1 |
| 5,758,990 | | 6/1998 | Davies et al. . | |
| 5,881,815 | * | 3/1999 | Horton, III | 166/350 |
| 6,027,286 | * | 2/2000 | Pollack | 405/195.1 |

FOREIGN PATENT DOCUMENTS

| | | |
|---|---|---|
| 2040599 | 1/1971 | (FR) . |
| 1533973 | 11/1978 | (GB) . |

* cited by examiner

*Primary Examiner*—Eileen D. Lillis
*Assistant Examiner*—Frederick L. Lagman
(74) *Attorney, Agent, or Firm*—Leon D. Rosen

(57) ABSTRACT

An offshore hydrocarbon production system includes a spar (34, 52, 214) that floats at the sea surface, a subsea buoy (26, 154, 200, 210) lying under the spar and hanging from it, and one or more risers (20, 174, 220) that extend up to the subsea buoy and are coupled therethrough to the spar. The subsea buoy is initially negatively buoyant to ballast of the spar and keep it upright, but the subsea buoy can be made positively buoyant so the spar can be moved away and a workover vessel (70) moved over the subsea buoy. The subsea buoy can be coupled to the spar by one or more chains (60, 60A) extending between them, and one or more flexible hoses (60) extending between them.

12 Claims, 7 Drawing Sheets

10
36
40
62
88
84
34
86
A
32
76
60
B
30
22
92
80
26
24
C
50
90
20
12
14
52
16

62
70
80
34
72
22
22
26
20
82

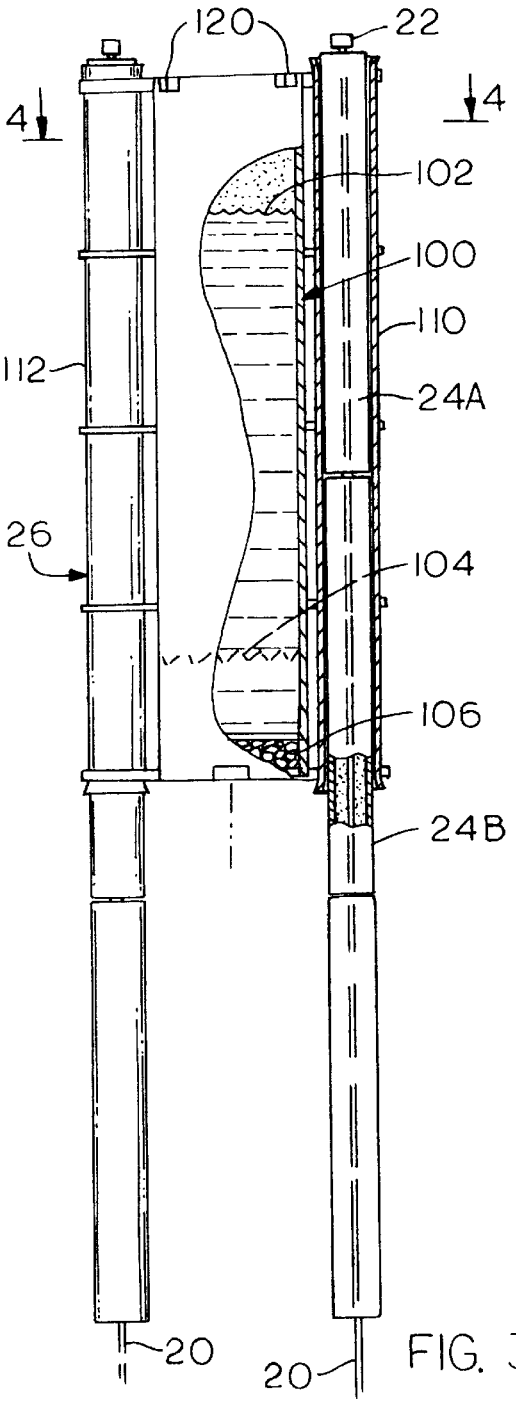
FIG. 3
FIG. 4
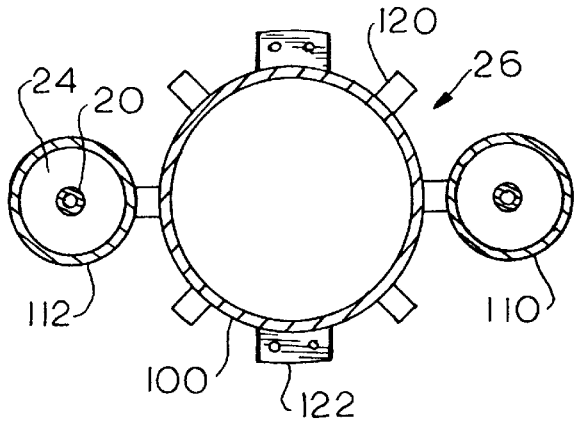
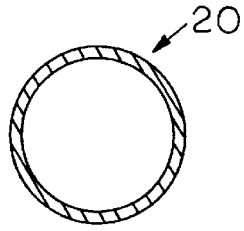
FIG. 5

SPAR SYSTEM

CROSS REFERENCE

Applicant claims priority from U.S. provisional patent application 60/074,469 filed Feb. 12, 1998.

BACKGROUND OF THE INVENTION

Offshore hydrocarbon production systems generally include a plurality of wells extending to undersea deposits of oil, with trees located on the sea floor, wherein each tree includes a plurality of valves and pipe couplings. Risers extend up from the trees to apparatus floating at the sea surface that has oil handling equipment. One low-cost production apparatus comprises a spar buoy or spar in the form of a body having a height that is a plurality of times its average width, and usually at least 5 times as tall as wide. The small width of the spar results in only moderate drift in reaction to winds, currents, and waves, which results in only moderate bending of the risers and fluid-carrying pipes therein. To keep the spar upright, its upper portion is made highly buoyant while its lower portion contains considerable ballast to weight it and thereby lower its center of gravity. There are several occasions when it would be desirable to disconnect a spar buoy from the risers that extend down to the sea floor. Some of these include disconnection when icebergs approach, and disconnection to permit use of a workover vessel such as a semi-submersible platform that carries pipes that can extend to the tree to carry tools to clean out wax deposits. In deep seas, expensive workover vessels must be used, with conduits that can extend down to trees at the sea floor. An offshore hydrocarbon production system that facilitated installation of the spar and its disconnection, especially to enable a workover vessel to work on the risers, trees and undersea pipes, would be of value.

SUMMARY OF THE INVENTION

In accordance with one embodiment of the present invention, an offshore installation is provided that uses a spar at the sea surface that is coupled through risers extending to the sea floor, which facilitates detachment of the spar in the event of an approaching iceberg or when conduits such as risers must be cleaned, and which simplified set-up of the system and ballasting of the lower end of the spar. The system includes a subsea buoy lying under the spar and attached to the spar. The subsea buoy can be made negatively buoyant to ballast the lower end of the spar and keep the spar upright. The subsea buoy can be made positively buoyant to hold up risers while the spar moves away from the vicinity of the installation. The upper ends of the risers can be attached to buoyancy cans that can slide vertically with respect to the subsea buoy to keep the risers taut, and with trees at the upper ends of the buoyancy cans. If a workover vessel is to be used, it can connect to the trees at the upper ends of the risers, without pipes from the workover vessel having to extend all the way down to the sea floor.

The subsea buoy can be hung from the lower end of the spar by a chain or other tension member which allows the spar to tilt by more than the subsea buoy, so as to minimize bending of the risers at the bottom of the subsea buoy. Flexible hoses extend from the upper end of the subsea buoy, as from the trees on the buoyancy cans, to the lower end of the spar, where the hoses connect to spar pipes extending up to handling equipment at the upper end of the spar. The use of a hanging ballast for a spar, can be used in any spar installation, where the hanging weight lies closer to the surface than the sea floor.

The novel features of the invention are set forth with particularity in the appended claims. The invention will be best understood from the following description when read in conjunction with the accompanying drawings.

BRIEF DESCRIPTION OF THE DRAWINGS

FIG. 3 is a partial sectional view of the system of FIG. 1, showing the subsea buoy, buoyancy cans attached to risers, and trees at the upper ends of the risers.

FIG. 4 is a sectional view taken on line 4—4 of FIG. 3.

FIG. 5 is a view of one of the risers of FIG. 4.

DESCRIPTION OF THE PREFERRED EMBODIMENTS

Figure 1:
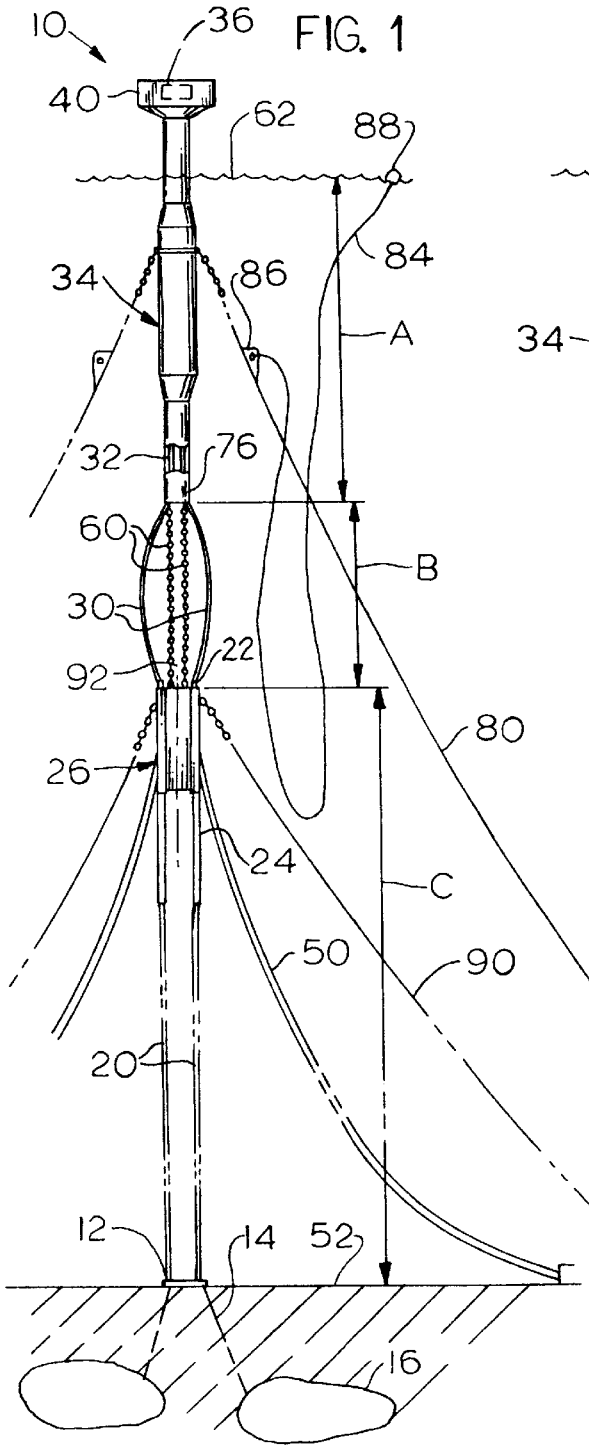
FIG. 1 is a side elevation view of an offshore installation constructed in accordance with one embodiment of the invention, in its usual configuration wherein the subsea buoy hangs from the spar.

FIG. 1 illustrates a hydrocarbon production system 10 of the present invention, which includes a sea floor base 12 and sea floor pipes 14 extending largely downwardly to reservoirs 16 in the seabed. Hydrocarbons from the reservoirs pass up through the pipes 14 and through one or more production risers 20 to trees 22. The trees include valves and couplings. The production risers 20 are kept under tension by buoyancy cans 24 or other means that can slide up and down within a subsea well head buoy 26. When valves on the trees 22 are open, the hydrocarbons pass up through flexible lines 30 to spar pipes 32 that lie within a spar 34 or on the outside of the spar hull. The spar pipes carry the hydrocarbons up to processing equipment 36 on a deck 40 of the spar. The processing equipment may remove sand and water. The processed hydrocarbons pass down through additional spar pipes 32 and additional flex lines 30, and pass down along export risers 50 that carry the hydrocarbons to a remote location such as an onshore processing plant or a storage vessel located in the vicinity of the spar 34, or a terminal. Although rudimentary valves may lie at the sea floor base 12, the more sophisticated valves and couplings such as remotely hydraulically operated valves and couplings lie at the trees 22 which lie high above the sea floor 52.

In one example, the underwater portion of the spar buoy has a height A of 292 feet, and the hangoff lines 60 have a height B of 164 feet. As a result, the top of the subsea buoy 26 lies about 450 feet below the sea surface 62. The height C of the top of the subsea buoy 26 above the sea floor is a plurality of hundreds of feet and is generally greater than its height (A+B) below the sea surface. As a result, the subsea buoy 26 lies where wave and current forces are negligible, and lies under most icebergs. Also, the tree 22 lies less than about 600 feet below the sea surface so shallow water workover vessels can be used to dean the risers (after the spar 34 is removed) and to clean the subsea buoy at a depth where it is diver accessible.

Figure 2:
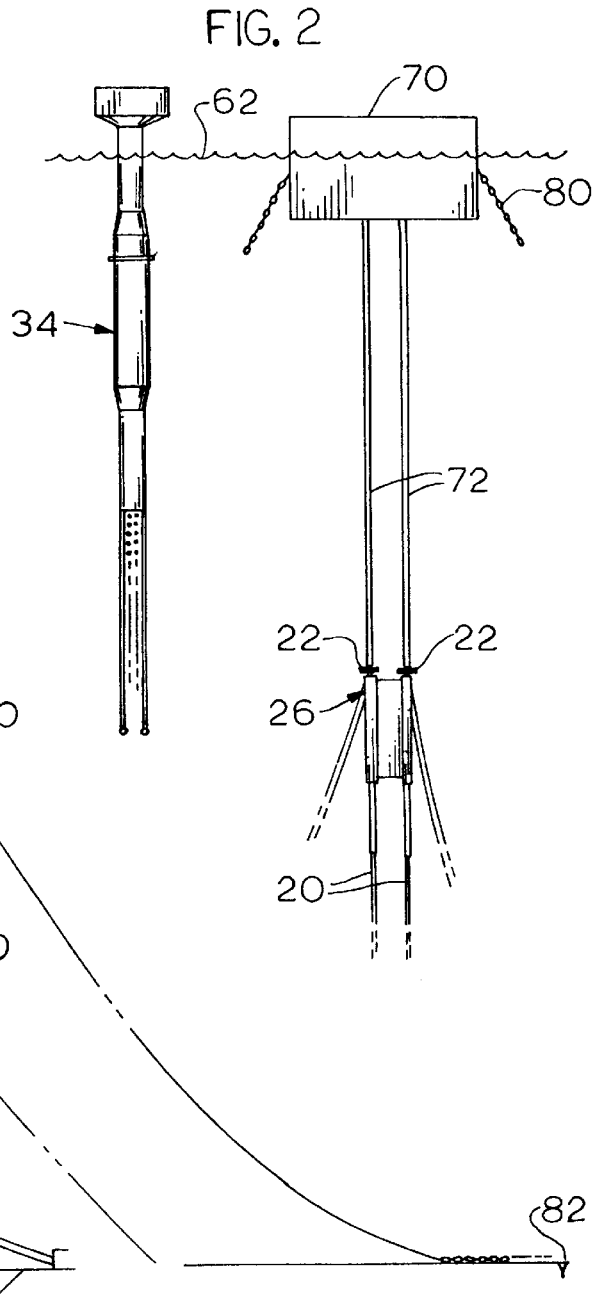
FIG. 2 is a partial view of the system of FIG. 1, with the spar disconnected from the subsea buoy and with a workover vessel lying over the subsea buoy.

FIG. 2 shows a situation where the wells are being worked over by a workover vessel 70 in the form of a semi-submersible platform, although other vessel shapes are possible. The spar 34 has been detached from the subsea buoy 26 and some water has been pumped into ballast chambers (not shown) of the spar to lower it somewhat in the water for stability. Water has been pumped out of the subsea buoy to make it (with loads on it) neutrally buoyant and the buoyancy cans are fixed to the subsea buoy, before disconnection from the spar. The workover vessel has lowered workover vessel pipes 72 by connecting pipe sections for a total length of about 400 feet, so they extend to and are connected to the trees 22. Then cleaning equipment passes down through the pipes 72, the production risers 20, and the sea floor pipes 14 to clean out wax buildup. When workover is completed, the workover vessel 70 is disconnected and towed or sailed away, and the spar 34 is reconnected. The top of the subsea well head buoy 26 is preferably located more than 200 feet but less than 800 feet, such 500 feet, below the sea surface 62, to isolate it from almost all wave action while making the trees reasonably accessible. In most cases the height C of the top of the well head buoy is at least 500 feet above the seafloor.

A spar normally includes air-filled tanks at its upper portion and ballast-filled containers (filled with high density material at its bottom to provide a large moment urging the spar to remain vertical and therefore to provide stability. Applicant constructs the subsea buoy 26 so that in the producing configuration of the system (FIG. 1), the subsea buoy 26 is negatively buoyant. This weight is applied to the bottom 76 of the spar 34 through the hangoff lines 60 that support the negatively buoyant subsea buoy 26. Because of the large load applied by the subsea buoy 26, the spar 34 does not need as much ballast at its lower end, and a smaller and lighter spar 34 can be used.

It is noted that it is known (e.g. U.S. Pat. No. 4,637,335) to use a weight hanging from the bottom of a tall transfer structure whose upper end moors a vessel that can drift far from its quiescent position (more than about 8% of the sea depth) in severe weather, unlike a spar, to obtain a "pendulum effect" that urges the structure and vessel back. Applicants tensioned risers 20 can accommodate only a moderate spar drift, which increases the distance between the seafloor base 12 and the subsea buoy 26 (e.g. no more than 10% of riser length by moving down the buoyant cans 24). Thus drift of the spar must be limited, by making the spar narrow and tall.

Applicant uses the subsea buoy, in addition to well supports, as an external spar ballast which lies below the spar and therefore which is effective in avoiding excessive tilt of the spar. The weight applied by the subsea buoy is applied to the extreme bottom of the spar where the weight is most effective in minimizing spar tilt. The separate subsea buoy and spar are easier to handle and transport than one massive spar. Although a massive spar can be moved in sections and welded at the site, the present system avoids the high cost of such welding.

The subsea buoy 26 is made positively buoyant before the spar 34 is to be disconnected from the subsea buoy 26 for the connection of the workover vessel, to avoid iceberg damage, or other reason. This is accomplished by pumping water out of tanks of the subsea buoy 26 until it is positively buoyant, so it can support itself and the weight of mooring chains and steel catenary risers (the risers 20 are kept taut by their own buoyancy cans).

The spar 34 is moored by a group of spar mooring chains 80 or other flexible lines that extend in catenary curves to the sea floor 52 and along the sea floor to anchors 82. Retrieval lines 84 extend from couplings 86 lying along the spar mooring chains up to marker buoys 88. When the spar is to be removed, each of the mooring chains 80 is separately disconnected from the spar and allowed to drop to the sea floor or be held suspended by small buoys. If a workover vessel 70 is to be used then it may pick up the marker buoys 88 and connect to the spar mooring chains 80. The subsea buoy 26 may be moored by its own buoy mooring chains 90 although this is not necessary in many cases, so chains 90 are not necessarily required.

In systems of the type shown in FIGS. 1–5, tilt motions of the subsea buoy can be controlled by variation in the length of the hangoff lines 60, and the amount of tension in the hangoff lines (variation in the weight of the subsea buoy). Tilt motions of the subsea buoy also can be controlled by choice of the radial distance between the axis 92 of the subsea buoy and locations where the hangoff lines are attached to the subsea buoy and the spars.

Figure 12:
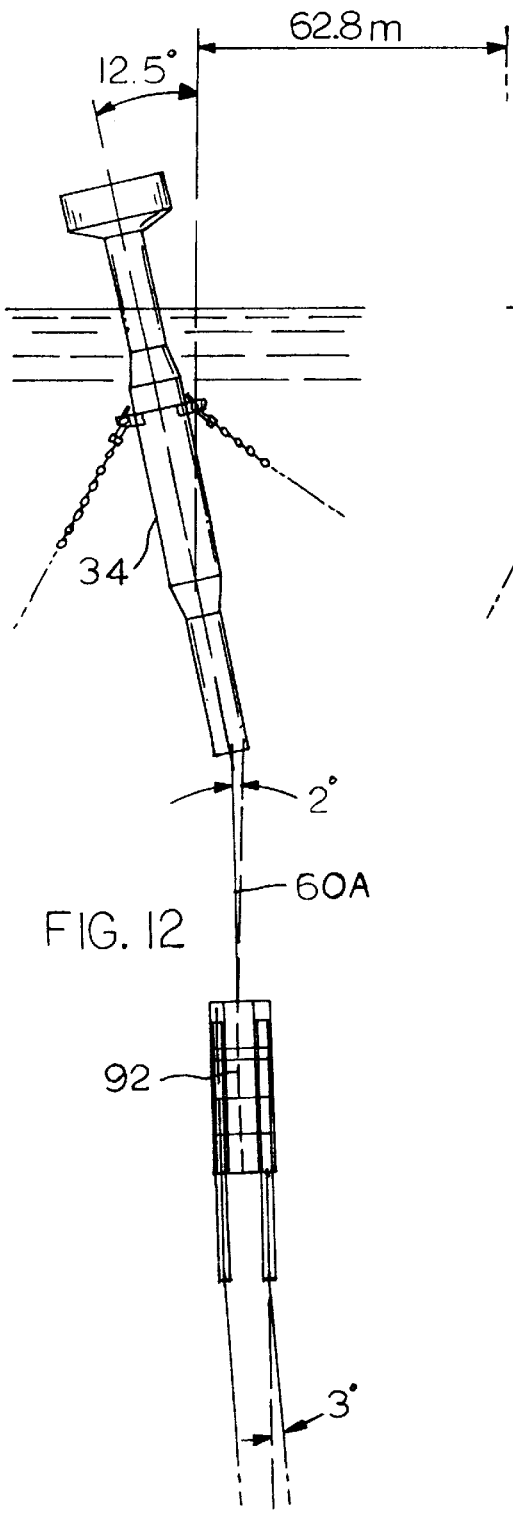
FIG. 12 is a view similar to that of FIG. 11, but with a central hang-off line rather than a plurality of hang-off lines.
Figure 11:
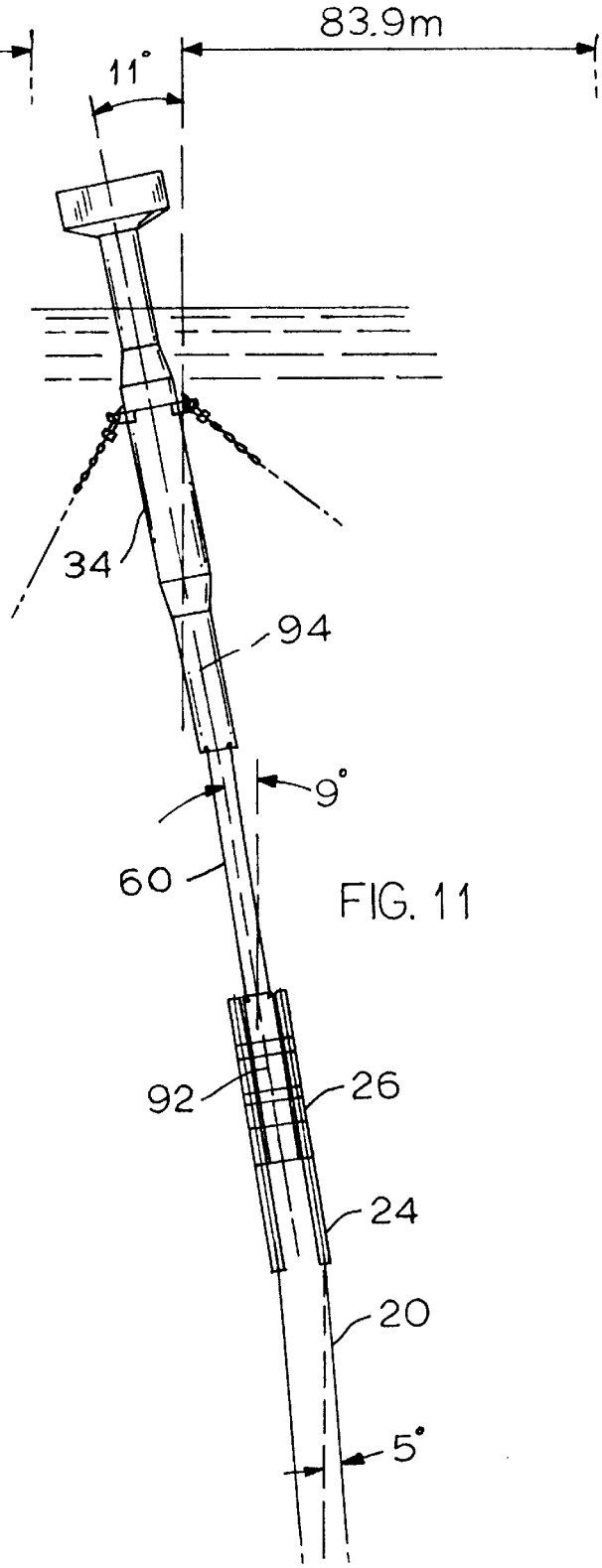
FIG. 11 is a side elevation view of a portion of the system of FIG. 1, with the spar having drifted, showing tilting of the various components.

In FIGS. 1–5 and 11 the hangoff lines 60 are attached to the radial outside of the subsea buoy and to the radial outside of the spar, and the subsea buoy pitch will be very dose to that of the spar. FIG. 11 shows a situation where the spar has drifted with the spar axis 94 tilted by 11°, and the subsea buoy 26 has tilted by 9° from the vertical. This results in the risers 20 undergoing a bend of 5° at the bottom of the can floats 24. This bending (bending about a small radius of curvature) would create high stress points and should be minimized to avoid design difficulties. FIG. 12 shows a situation where hangoff lines 60A are attached close to the axes of the spar and subsea buoy, resulting in a smaller pitch angle of the subsea buoy. In FIG. 12, the spar has drifted and the spar axis has tilted by 12.5°, and the subsea buoy has tilted by 2° from the vertical. The risers 20 undergo a bend of 3° at the bottom of the subsea buoy. The hangoff chains can be placed so the subsea buoy and the risers tilt almost in unison for a certain range of spar drift, to minimize riser bending and high stress points. It should be noted that the hangoff lines are pivotally connected at their upper and lower ends to the spar and subsea buoy, respectively. While flexible chains or cables are desirable, it would be possible to use rigid rods whose ends are pivotally connected.

FIG. 3 illustrates some details of the subsea buoy 26. The buoy includes a large tank 100, that may include bulkheads to separate it into multiple chambers. When the subsea buoy is connected to the spar, the tank is filled with water, as to the level 102 so that the buoy 26 with its permanent high density ballast 106 applies a large weight to the spar and acts as an external ballast. However, when the buoy 26 must float to support itself, the export risers 50, and the weight of any buoy mooring chains thereon, the water is pumped out as to the level 104, to make the buoy 26 and loads thereon neutrally buoyant. It is noted that the subsea buoy holds high density material at 106.

The buoy 26 includes I-tubes 110, 112. Buoyancy cans such as 24A, 24B can slide vertically within the tubes which serve as vertical guideways. The buoy 26 is allowed to heave (move up and down) as the spar 34 of FIG. 1 moves up and down in the waves. The buoyancy cans 24 are rigidly attached to the production risers 20 which are attached to the well templates at the sea bed which anchor the risers to the sea floor. Accordingly, the tubes of the subsea buoy 26 move up and down around the buoyancy cans. If the spar drifts under the influence of wind, waves and currents, the buoy 26 will also drift and the can floats 24 will drift and move downward within the tubes since the risers 20 are of a fixed length. Thus, while horizontal translation motions of the spar and subsea buoy are coupled, the risers do not move up and down with the spar and subsea buoy. In summary, the translational motions are coupled while heave is uncoupled.

FIG. 4 is a sectional view of the subsea wellhead buoy 26 of FIG. 3. It shows the tubes 110, 112 on opposite sides of the tank 100. Mooring line connectors 120 connect to the hangoff lines 60. Flexible riser couplings 122 connect to export/import risers. FIG. 5 is one example of a sectional view of a riser 20.

Figure 6:
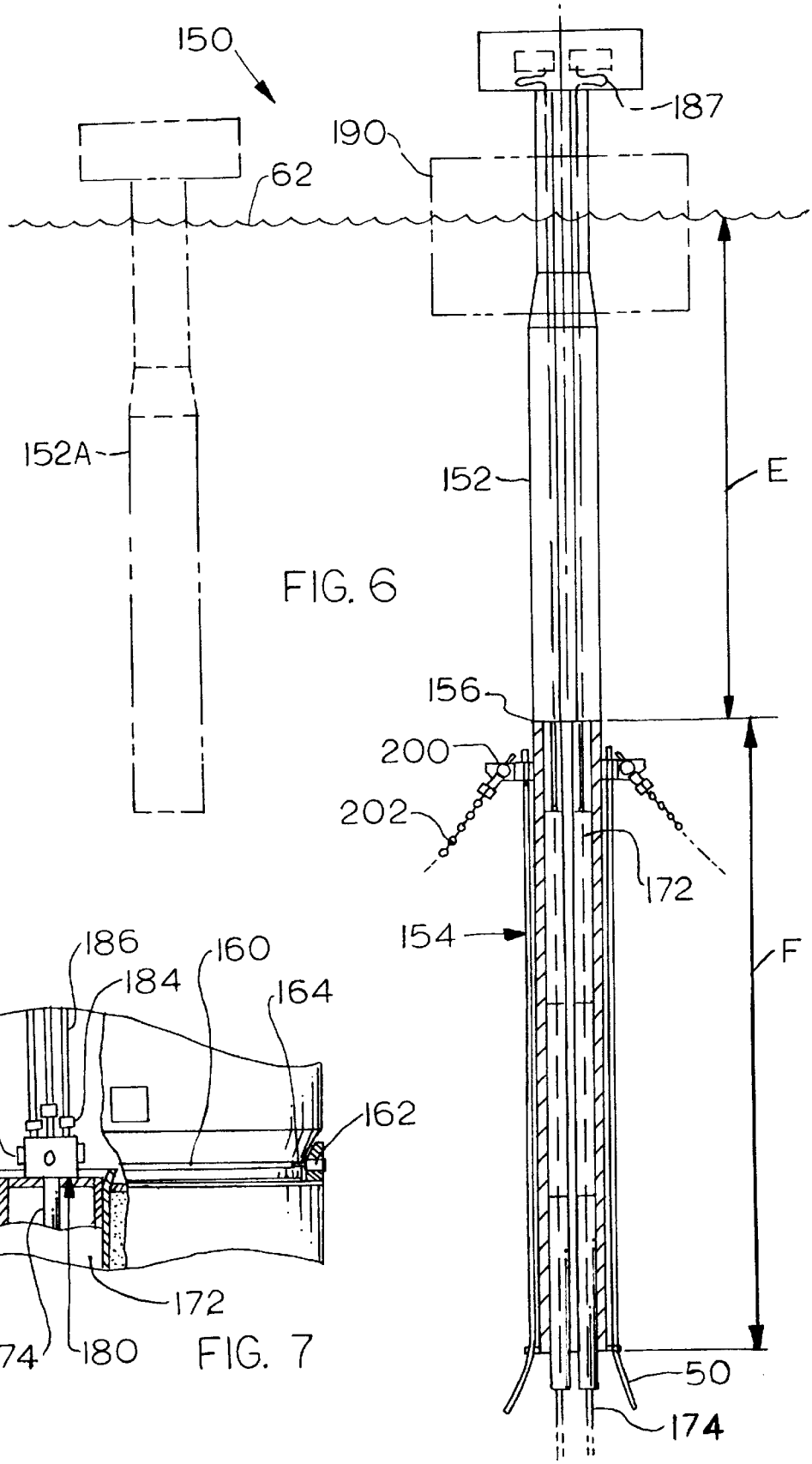
FIG. 6 is a partial sectional view of an installation of another embodiment of the invention, wherein the spar and subsea buoy are disconnectably fixed together, and showing, in phantom lines, the spar disconnected and moved away and a makeover vessel in its place.
Figure 7:
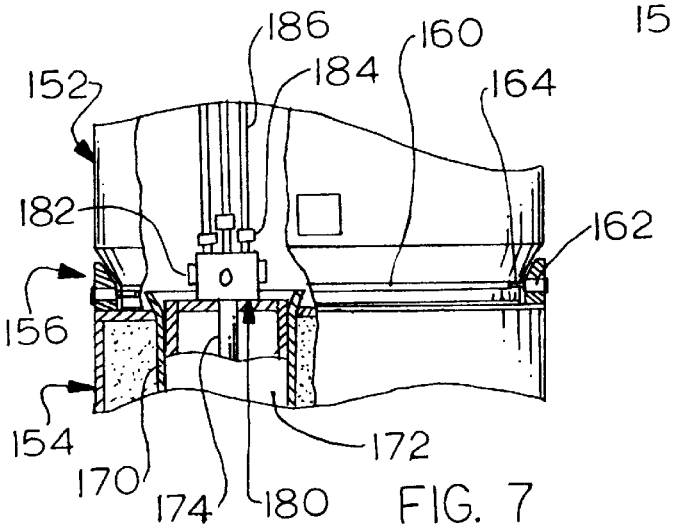
FIG. 7 is a more detailed view of a portion of the system of FIG. 6, showing the connecting apparatus.

FIG. 6 illustrates another system 150 which includes a spar 152 and a separate subsea buoy 154. The spar 152 and buoy 154 are fixed together at a coupling 156, instead of having the buoy 154 hang through hangoff lines from the bottom of the spar. FIG. 7 shows that the bottom of the spar 152 includes a groove 160 and that the coupling 156 includes hydraulic actuators 162 with pistons 164 that enter the groove 160 to lock the spar 152 to the buoy 154. The subsea buoy 154 includes tubes 170, with can floats 172 being vertically slidable within the tubes, and with risers 174 lying within the can floats. A tree 180 lies at the top of the uppermost can float 172 and has multiple remotely-operable valves 182 and pipe couplings 184. Spar pipes 186 move up and down within the shell of the spar, and flexible couplings (187 in FIG. 6) are contained within the spar to accommodate such vertical movement.

When the spar 152 is connected to the subsea buoy 154 as shown in solid lines in FIG. 6, the subsea buoy 154 is made negatively buoyant, by flooding its tank with water. When the spar 152 is to be disconnected, as when a workover vessel 190 must be used, the spar is disconnected and floats to the position indicated at 152A.

In a system of the type shown in FIG. 6 that applicant has designed, the top of the buoy 154 lay a distance E of 210 feet below the sea surface 62. Wave action thereat is relatively low, and movement of the buoy 154 is minimized in rough weather by the fixing of the spar 152 to the buoy 154. The buoy 154 had a height F of 263 feet. The risers 174 extended to the sea floor in the same manner as shown in FIG. 1, with export risers 50 similarly extending to the sea floor. Only a single chain table 200 and mooring chains or lines 202 are required since the spar and buoy are fixed together.

Figure 8:
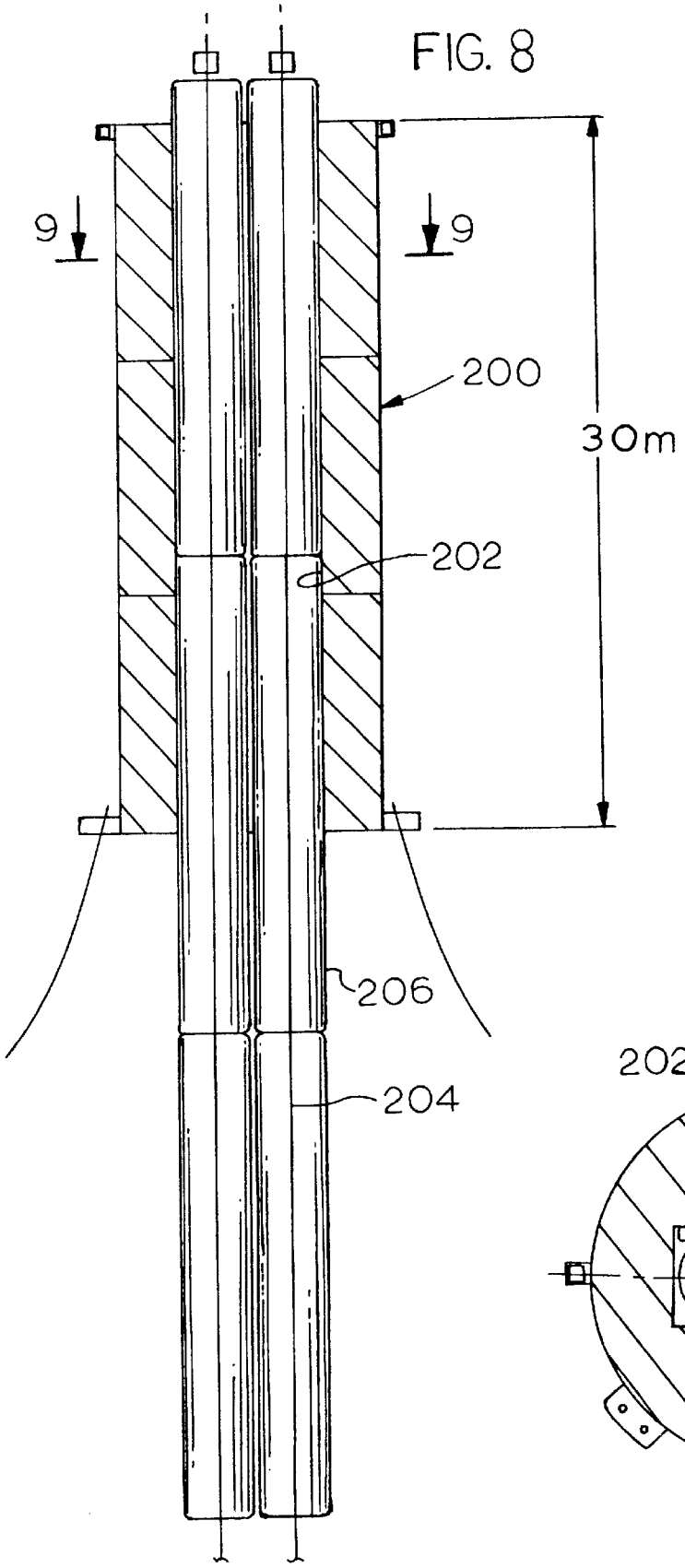
FIG. 8 is a partial sectional view of an offshore installation of another embodiment of the invention, wherein the buoyancy cans slide along a moonpool within the subsea buoy.
Figure 9:
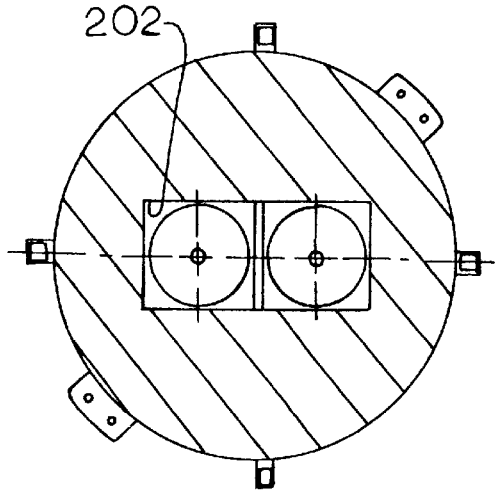
FIG. 9 is a sectional view taken on line 9—9 of FIG. 8.
Figure 10:
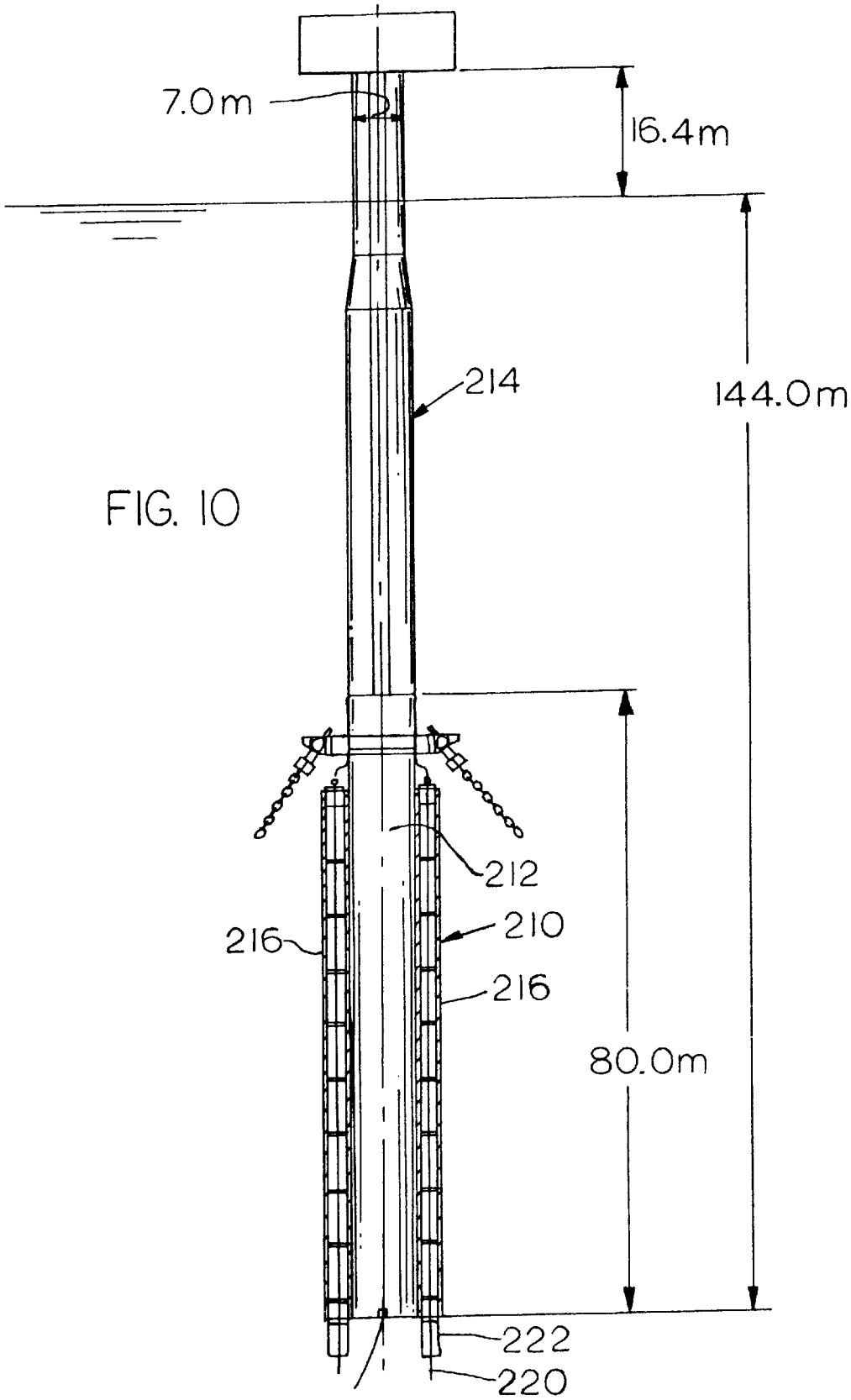
FIG. 10 is a partial sectional view of an offshore installation similar to that of FIG. 6, but with the buoyancy cans sliding within external I-tubes of the subsea buoy.

The systems can be constructed in different ways. As shown in FIGS. 8 and 9, the subsea buoy 200 can be provided with a moonpool 202, with production risers 204 passing through buoyancy cans 206 passing through the subsea buoy. The subsea buoy can be used to support only flexible risers, with the well heads at the sea floor. FIG. 10 shows a subsea buoy 210 with a buoy part 212 damped to a spar 214, where I-tubes 216 lie outside the buoy part. Risers 220 are fixed to buoyancy cans 222 that can slide within the I-tubes.

Figure 13:
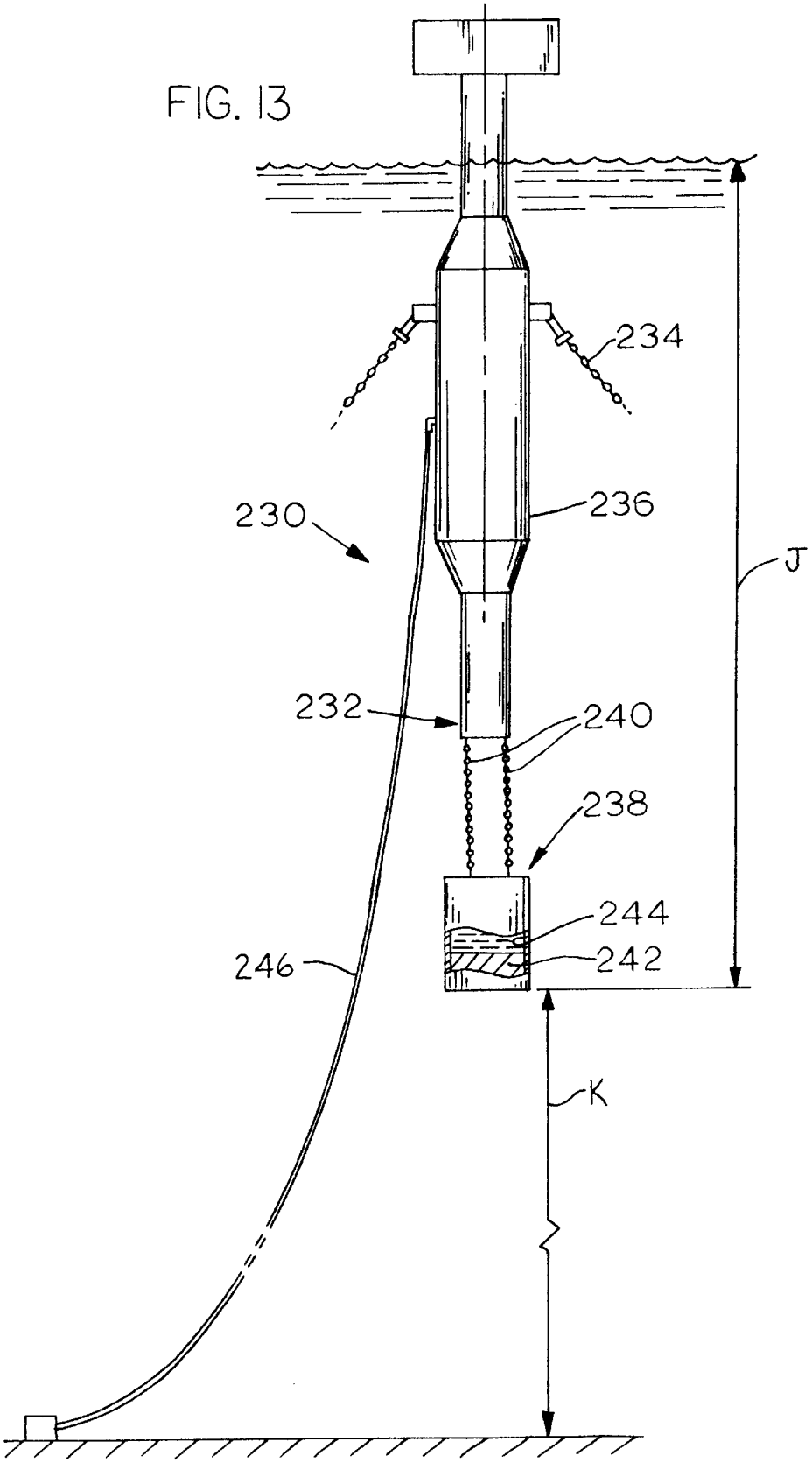
FIG. 13 is a partial sectional view of an offshore installation of another embodiment of the invention, wherein a subsea buoy part is permanently attached to a spar.

FIG. 13 shows a production system 230 with a permanently moored spar assembly 232 moored by lines 234 extending the sea floor. The spar assembly includes a spar part 236 and a subsea hung part 238 hung by hangoff lines 240 from the spar part. The lines 240 are preferably longer than the average width of the spar part 236 or hung part 238. The subsea hung part 238 includes a quantity of high density material 242 (e.g. iron ore) and a tank 244 that is normally filled with water. The spar part 236 is easier to install, while the hung part is especially effective in keeping the spar part upright. The figure shows a production riser 246 for carrying hydrocarbons. The hung part 238 preferably lies a distance J below the sea surface, which is less than its height K above the sea floor. In one example, the height J is 100 meters while the height K is 200 meters.

Thus, the invention provides an offshore hydrocarbon production system of the type that includes a spar (a long thin buoyant body), that produces oil from undersea wells, which minimizes cost. A subsea buoy lies under the spar with trees on the subsea buoy connected through vertical risers to pipes that lie within the seabed. A spar of only moderate weight and cost is provided by fixing or hanging a separate weight from its lower end, where the weight is a negatively buoyant subsea buoy whose tank can be made positively buoyant or highly negatively buoyant. The subsea buoy normally is negatively buoyant to weight the bottom of the spar, but is converted to a positively buoyant state to support the risers, trees and mooring lines before the spar is disconnected.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An offshore installation comprising:

a buoyant spar which floats at the sea surface and can drift, and that has a vertical length that is a plurality of times greater than its average width, and having upper and lower ends;

a subsea buoy which lies below the sea surface and above the sea floor and which can drift, said subsea buoy having upper and lower ends and having a tree, with said subsea buoy upper end and said tree being detachably connected to said spar lower end and with said subsea buoy being capable of being negatively buoyant to hang from said spar buoy and help keep said spar buoy vertical, and said subsea buoy being made capable of being made positively buoyant to float at an underwater depth when disconnected from said spar buoy;

at least one riser extending from the sea floor to said subsea buoy.

2. The installation described in claim 1 wherein:

said spar and said subsea buoy are vertically spaced; and including at least one vertically elongated tension member that hangs from said spar and is connected to said subsea buoy, with said tension member being pivotally connected to both said spar buoy and said subsea buoy.

3. The installation described in claim 1 wherein:

said spar lower end is connected to said subsea buoy upper end in a rigid joint that prevents relative movement and tilt of said spar buoy and said subsea buoy.

4. The installation described in claim 3 wherein:

a chain table mounted on said subsea buoy and a plurality of chains extending in catenary curves therefrom to the sea floor.

5. An offshore installation comprising:

a spar that floats at the sea surface and that has upper and lower ends;

a subsea buoy which lies below said spar and is detachably connected to said spar, said subsea buoy having at least one chamber that can be filled with air and water to make said subsea buoy positively and negatively buoyant, and said subsea buoy having at least one vertical tube;

a buoyancy can which is slidably received in said tube;

a tree mounted on an upper end of said buoyancy can;

a riser which has a lower end anchored to the sea floor and an upper end portion that extends through said buoyancy can and is fixed to it and which has an upper riser end connected to said tree;

a conduit which extends from said tree to said spar upper end.

6. The installation described in claim 5 wherein:

said subsea buoy lies a distance below said spar lower end; and including at least one tension member extending primarily vertically between said spar and said subsea buoy and which is pivotally connected to each of them;

at least one flexible hose which has a lower end coupled to said tree and an upper end connected to said spar, with said hose extending in a curve.

7. The installation described in claim 6 wherein:

said subsea buoy lies closer to the sea surface then to the sea floor.

8. An offshore installation for use in a sea, comprising:

a spar which floats at the sea surface and which has upper and lower ends and a height that is plurality of times greater than its average diameter;

a mooring system which includes a plurality of lines having upper ends connected to said spar and lower ends anchored to the sea floor;

a weight which is negatively buoyant;

a vertically elongated tension member which extends between the lower end of said spar and said weight and which has an upper end pivotally connected to said spar and a lower end pivotally connected to said weight;

said weight lies closer to the sea surface than to the sea floor.

9. A method for operating an offshore installation lying above a subsea well, comprising:

attaching the upper end of a subsea buoy to the lower end of a spar and allowing the spar to float at the sea surface while the subsea buoy is negatively buoyant and lies under said spar;

establishing a tree at the upper end of said subsea buoy;

coupling an upper end of said spar to said subsea well by risers extending up from the well and through at least part of said subsea buoy to said tree, and connecting said tree to a spar pipe on said spar where said spar pipe extends to said upper end of said spar;

pumping water out of chambers of said subsea buoy to make it positively buoyant, detaching said spar from said subsea buoy, moving said spar away from a location above said subsea buoy, and moving a workover vessel over said subsea buoy and said tree thereon.

10. An offshore installation comprising:

a buoyant spar which floats at the sea surface and can drift, and that has a vertical length that is a plurality of times greater than its average width, and having upper and lower ends;

a subsea buoy which lies below the sea surface and above the sea floor and which can drift, said subsea buoy having upper and lower ends, with said subsea buoy upper end being detachably connected to said spar lower end and with said subsea buoy being capable of being negatively buoyant to hang from said spar buoy and help keep said spar buoy vertical, and said subsea buoy being capable of being made positively buoyant to float at an underwater depth when disconnected from said spar buoy;

at least one riser extending from the sea floor to said subsea buoy;

said spar has hydrocarbon processing equipment at said upper end of said spar, and said spar has at least one spar pipe extending along most of the vertical length of said spar with a spar pipe upper end connected to said processing equipment and with a spar pipe lower end;

a tree that lies adjacent to said subsea buoy upper end and that is connected to said riser;

said spar and subsea buoy are vertically spaced; and including a tension member connecting said spar buoy and subsea buoy and being pivotally coupled to each;

a flexible hose extending in a curve between said tree and said spar pipe lower end.

11. The installation described in claim 10 wherein;

said subsea buoy has a vertical guideway, and including a buoyant can that is slideably coupled to said guideway to move up and down along it, with said buoyant can being fixed to said riser upper end to support it, and with said tree being fixed to said buoyant can, and with said flexible hose being long enough compared to the spacing of said spar buoy and subsea buoy to avoid being puled taut.

12. The installation described in claim 11 wherein:

said subsea buoy has a vertically elongated central tank and has a plurality of tubes spaced about the outside of said central tank, with said buoyant can lying in one of said tubes.

* * * * *